United States Patent [19]

Kathke

[11] Patent Number: 5,074,481

[45] Date of Patent: Dec. 24, 1991

[54] METHOD AND APPARATUS FOR MONITORING THE YARN WINDING PRODUCTION PROCESS

[75] Inventor: Gregor Kathke, Viersen, Fed. Rep. of Germany

[73] Assignee: W. Schlafhorst AG & Co., Mönchengladbach, Fed. Rep. of Germany

[21] Appl. No.: 528,139

[22] Filed: May 23, 1990

[30] Foreign Application Priority Data

May 25, 1989 [DE] Fed. Rep. of Germany ..... 3917055

[51] Int. Cl.[5] ..... B65H 63/00; B65H 54/20

[52] U.S. Cl. ..... 242/36; 242/35.50 R

[58] Field of Search ..... 242/36, 37 R, 39, 18 R, 242/35.5 R, 45

[56] References Cited

U.S. PATENT DOCUMENTS

| | | | |
|---|---|---|---|
| 3,801,031 | 4/1974 | Kamp et al. | 242/36 |
| 4,214,717 | 7/1980 | Makino et al. | 242/36 |
| 4,666,096 | 5/1987 | Heel et al. | 242/36 |
| 4,880,175 | 11/1989 | Yamauchi et al. | 242/36 |
| 4,964,582 | 10/1990 | Hermanns et al. | 242/36 |
| 4,984,749 | 1/1991 | Matsui et al. | 242/36 |

FOREIGN PATENT DOCUMENTS

| | | |
|---|---|---|
| 2052117 | 4/1972 | Fed. Rep. of Germany . |
| 2625805 | 12/1976 | Fed. Rep. of Germany . |
| 2700287 | 7/1977 | Fed. Rep. of Germany . |
| 2951552 | 7/1981 | Fed. Rep. of Germany . |
| 3005746 | 8/1981 | Fed. Rep. of Germany . |

*Primary Examiner*—Stanley N. Gilreath

*Attorney, Agent, or Firm*—Herbert L. Lerner; Laurence A. Greenberg

[57] ABSTRACT

In a method and apparatus for monitoring a yarn winding production process, the traversing amplitude and/or the traversing frequency are monitored by a cross-winding monitoring system, which supplies cross-winding signals over electrical lines to a control and information device, in which the signals are linked with set-point values and/or signals characterizing the winding operation. Conclusions are drawn from the linkage results as to a plurality of characteristics of the winding process, such as misfeeds, drum laps, bobbin laps, ribbon winding state, yarn tensioner function, yarn tension change, drum malfunction, cheese grading, type of cross-winding system and quality of the cheese.

27 Claims, 4 Drawing Sheets

METHOD AND APPARATUS FOR MONITORING THE YARN WINDING PRODUCTION PROCESS

The invention relates to a method and an apparatus for monitoring the yarn winding production process of bobbin winders of a machine producing cross-wound bobbins or cheeses. Such machines are known, for instance, as automatic winders, winding machines, texturing machines, spinning machines and spinning-winding machines.

With the new development of cheese-producing machines that operate particularly effectively, it has been found that the conventional methods and apparatus for monitoring the yarn winding production process are no longer adequate to assure high-quality winding operation in modern machine constructions. There are various reasons for such inadequacy. Among them is, for instance, the increase in winding speed, the transition to more-effective and above all higher-speed yarn splicing methods, the change and improvement in fiber mixtures, the high demands made for yarn uniformity, the reduction in size of skeins to be rewound to make cheeses, and others.

German Published, Non-Prosecuted Application DE-OS 2 052 117 discloses a method and apparatus for monitoring the winding formation on the yarn guide drum of winding machines, in which the size of the traversing stroke of the yarn is monitored, and the winding process is interrupted if it drops below the set-point variable.

German Published, Prosecuted Application DE-AS 2 259 389 discloses an electronic yarn monitor for textile machines having a feeler element that can be influenced by the yarn motion either directly or indirectly for converting the mechanical variables into electrical variables that serve to actuate the shutoff device of the textile machine, if a predetermined value of the electrical variables is either exceeded or fails to be attained within a predetermined period of time. The electrical variables generated by the feeler elements serve to effect a change in the shutoff threshold that is inversely proportional to the yarn speed.

It is accordingly an object of the invention to provide a method and apparatus for monitoring the yarn winding production process, which overcome the hereinafore-mentioned disadvantages of the heretofore-known methods and devices of this general type and which create the prerequisities for effective operation of modern cheese-producing machines, while adhering to a high standard of quality.

With the foregoing and other objects in view there is provided, in accordance with the invention, a method for monitoring the yarn winding production process of bobbin winders of a machine producing cross-wound bobbins or cheeses, which comprises monitoring at least one of the traversing amplitude and/or traversing frequency of a yarn running from a stationary yarn guide device through a cross-winding device onto a cheese with a cross-winding monitoring system emitting signals proportional to at least one of the traversing amplitude and/or traversing frequency; supplying the signals to a control and information system of the machine specifying set-point values determining a winding operation; monitoring adherence to the set-point values with sensors connected to the control and information system, influencing at least one of drive devices, yarn guide devices or the like in an open or closed-loop manner and tripping information and reporting and switching events pertaining to the winding operation with the control and information system in the event of deviations from the set-point value for assuring the winding operation; and linking the signals proportional to at least one of the traversing amplitude and/or traversing frequency with at least one of the set-point values and/or signals and information characterizing the winding operation and being optionally obtained with sensors monitoring winding operation in the control and information system with a logic element, for drawing conclusions from the result of the linkage as to a plurality of selectable characteristics of the ongoing winding process from the group consisting of misfeeds, drum laps, bobbin laps, ribbon winding state, yarn tensioner function, yarn tension change, drum malfunction, cheese grading, type of cross-winding system and quality of the cheese and optionally simultaneously tripping the switching, control and information events as a reaction to the conclusions, and optionally calling up, displaying and/or logging the conclusions at any time.

Modern control and information systems are equipped with programmable computers that also contain configurations for logical linkage of the signals and information.

The following instructions for practical processing of the relevant programs can be given to the programmer of a data processing system of this kind:

Misfeeds of the yarn within the traversing triangle are involved if the traversing amplitude decreases spontaneously or the traversing frequency increases spontaneously. However, misfeeds also occur if neither the amplitude nor the frequency is measurable, yet the travel signal is still present. This last-mentioned operating state must be interpreted as a drum lap if the yarn is running onto the yarn guide drum without the bobbin diameter increasing. On the other hand, it must be interpreted as a bobbin lap if the bobbin diameter is simultaneously increasing. In the case of the drum lap, a loop of yarn forms on the yarn guide drum, while in the case of the bobbin lap a similar loop of yarn forms on the cheese itself. The ribbon breaking state is considered good if the traversing frequency neither matches the bobbin rpm nor is an even multiple of the bobbin rpm. In contrast, the ribbon breaking state must be classified as in need of improvement if the bobbin rpm approaches a multiple of the traversing frequency.

The yarn tensioner function is classified as satisfactory if the ratio between traversing frequency and bobbin rpm is decreasing steadily but very slowly, in accordance with the increase in bobbin size. If the ratio fluctuates, the yarn tensioner function must be classified as unsatisfactory. Fluctuations in the ratio or deviations also indicate impermissible changes in yarn tension, regardless of whether or not a yarn tensioner is switched on.

A conclusion of drum malfunction must be drawn whenever there are intermittent changes in the traversing frequency or decreases in the traversing amplitude. If the normal frequency or the normal amplitude is then resumed, the winding operation can proceed, but if the drum malfunction occurs relatively often, then the cheese has to be graded as a "second", because the bobbin formation is not to standard, and problems and reductions in quality can ensue later during dyeing or rewinding.

The type of cross-winding device is a product of the ratio between traversing frequency and drum rpm, or the rpm of the bobbin tube at the onset of winding. If the cross-winding device is a yarn guide drum provided with reversing thread grooves, which also drives the cheese by friction, then the types of cross-winding device are distinguished in accordance with the number of intersections of the reversing thread groove and in accordance with the drum diameter.

The quality of the cheese can also be judged by various criteria. These criteria, are for instance, the number and duration of misfeeds; the number of drum laps and bobbin laps to be corrected; the ribbon breaking state during the bobbin travel; the yarn tensioner function or change in yarn tension during bobbin travel; the number, severity and duration of drum malfunctions; the number of yarn breaks; and the number of times the yarn has to be pieced. To this end, in automatic winders, the number of cop change operations occurring during the bobbin travel is, for instance, ascertained, stored in memory and evaluated.

The programs can provide for the processed conclusions to be called up, displayed and/or logged at any time. The computer is therefore connectable to the appropriate peripheral equipment such as a printer or monitor. The programs can also be expanded with a special statistical program, so that statistical overviews of the function of the various winding devices, groups of winding devices of the same batch of yarn, and the entire machine are obtained.

If the aforementioned conclusions as to the production process do not immediately lead to a shutoff or a corrective open or closed-loop operation, then in any case a manual intervention into the course of production can be made no later than upon callup of the data. Provision can also be made for the output of warning signals of various kinds. For instance, the machine operator can have the data callup automatically presented to him cyclically. Furthermore, he can call up the data by using the keyboard, the choice being entirely his own.

With the objects of the invention in view, there is also provided an apparatus for monitoring the yarn winding production process of winding devices of a machine producing cross-wound bobbins or cheeses having a yarn guide device and a traversing device, comprising an MIC (monitoring information control) system on the machine for permanently monitoring each winding device of the machine in accordance with definable and adjustable criteria, the MIC system including winding station computers for the winding devices, a central processing unit, set-point value transducers for production parameters and basic setting values, at least one memory for actual data occurring during production, devices for processing data according to programs, and a device for issuing control commands and signals; devices or manipulators connected to the MIC system for controlling cheese production; sensors connected to the MIC system for monitoring a yarn winding production process and for detecting each production change as well as the current yarn length of an individual cheese continuously or at predeterminably short time intervals; the MIC system having means for processing each production change and the current yarn length of the individual cheese into control signals and optionally into report signals and logs; a cross-winding monitoring system including measuring instruments on the winding devices being connected to the MIC system, the cross-winding monitoring system continuously monitoring at least one of the traversing amplitude and traversing frequency of yarn running from the yarn guide device through the traversing device onto a cheese and generating cross-winding signals proportional to at least one of the traversing amplitude and traversing frequency; and the MIC system having a logic element for linking the crosswinding signals and drawing conclusions from a linkage result as to a plurality of selectable characteristics of the ongoing winding process from the group consisting of misfeeds, drum laps, bobbin laps, ribbon winding state, yarn tensioner function, yarn tension change, drum malfunction, cheese grading, type of cross-winding system, quality of the cheese and current yarn length and the logic element optionally simultaneously trips switching, control and information events as a reaction to the conclusions, and optionally means for at least one of calling up, displaying and/or logging the conclusions at any time.

Further reference to the apparatus will be made below in the description of an exemplary embodiment.

In accordance with another feature of the invention, the winding stations are divided into winding station group, the MIC system includes means for performing dialog operation with the machine to be monitored and with a machine operator, and the MIC system includes a plurality of group memories each being assignable to at least one winding device for adopting basic setting values, for receiving the production parameters, and for storing the actual data occurring during production of an assigned winding station group.

This takes in account the fact that, for instance, various batches of yarn can be processed by the same automatic winder, and one or more winding stations can in turn be associated with each batch.

In accordance with a further feature of the invention, the traveling traversing yarn defines a traversing triangle, and the cross-winding monitoring system includes a sensor disposed next to the traversing triangle forming an end stop for the traveling traversing yarn emitting a signal or pulse upon contact with the yarn.

Contactless sensors already exist, but in this case, a contact is quite consciously intended to take place, in other words even if only slight force is exerted upon the sensor or some element connected to the sensor. Such sensors are less likely to malfunction and are very reliable in operation.

In accordance with an added feature of the invention, the sensor disposed next to the traversing triangle, or a sensor separate therefrom, emits a yarn travel signal, and the MIC system includes means for recognizing the pulse as a crosswinding pulse only if the yarn travel signal is simultaneously emitted. If this condition is not met, then a yarn that for whatever reason is only traversing but not traveling could be interpreted as one that is traversing properly, which would necessarily lead to incorrect information.

In accordance with an additional feature of the invention, there is provided another sensor disposed next to the traversing triangle, each of the sensors disposed next to the traversing triangle being disposed at a respective side of the traversing triangle. Such a configuration has advantages. Two pulses are emitted per double traversing stroke. If one of the two pulses does not occur, then a cross-winding malfunction is present.

In accordance with yet another feature of the invention, there are provided two end stops for the yarn each being disposed at a respective side of the traversing triangle and being connected to the sensor. In this configuration again, two pulses occur per double traversing stroke.

In accordance with yet a further feature of the invention, the cross-winding monitoring system has a yarn sensor disposed next to the traversing triangle, the yarn touching the yarn sensor during a traversing motion for issuing a yarn signal and the yarn moving past the yarn sensor at the end of the traversing motion for issuing yarn interrupting signals until the return of the yarn, at least one of the yarn signal occurring at the rhythm of a traversing frequency and the interruption yarn signals representing a measure of at least one of the traversing frequency and an adequate height of a cross-winding amplitude. In this configuration again, at least two and no more than four signals or pulses are provided that can be distinguished from one another per double traversing stroke.

In accordance with yet an added feature of the invention, the sensors disposed next to the traversing triangle respond to at least one of flexion, pressure, friction, torsion and elongation, and optionally there are provided bars or bending bars connected to the sensors disposed next to the traversing triangle.

In accordance with a concomitant feature of the invention, the sensors disposed next to the traversing triangle have strain gauges, elongator strips, triboelectric elements, piezoelectric elements, Hall elements and/or semiconductor modules disposed thereon.

Other features which are considered as characteristic for the invention are set forth in the appended claims.

Although the invention is illustrated and described herein as embodied in a method and apparatus for monitoring the yarn winding production process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
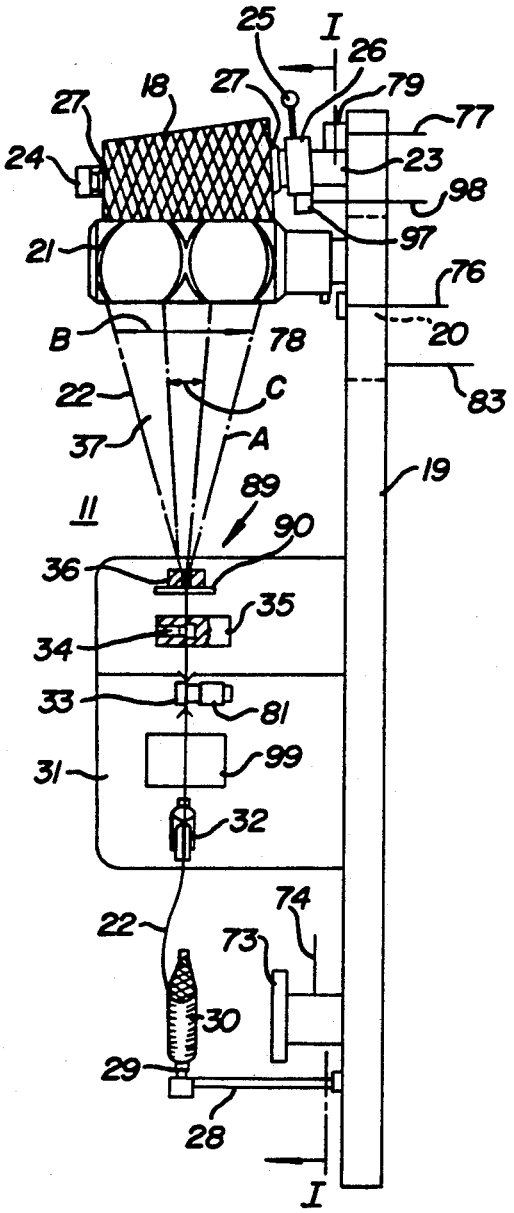
FIG. 2 is a front-elevational view of the winding station of FIG. 1.
Figure 3:
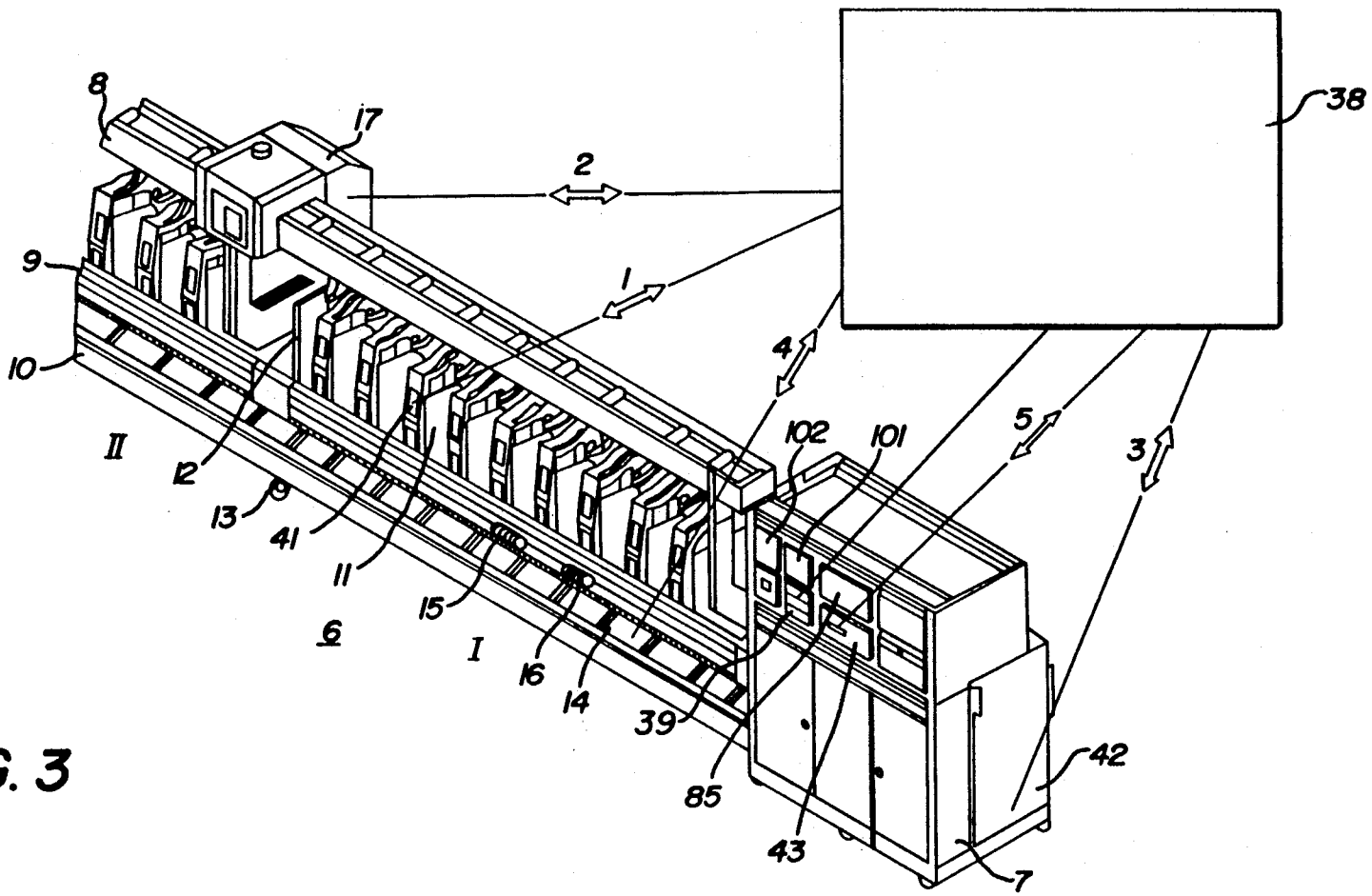
FIG. 3 is a fragmentary perspective view of the automatic winder on a greatly reduced scale.

Referring now to the figures of the drawing in detail and first, particularly, to FIG. 3 thereof, there is seen an automatic winder 6 having a so-called end frame on both ends, of which an end frame 7 on the right is visible. The end frame 7 takes the form of a cabinet that contains central drive systems, control systems and the like. The two end frames are connected together by flexurally stable traverse beams 8, 9, 10, so that the result is a stable machine frame. The traverse beams support various winding devices 11. A plurality of winding devices 11 are combined to make one section or winding station group I or II. Special partitions 12 are present at the section boundaries, and the lower traverse beams 10 have vertically adjustable feet 13 at the section boundaries. A winding device 11 is shown in two views in FIGS. 1 and 2 which will be discussed below.

Disposed in the vicinity of the traverse beam 10 is a supply device 14, which serves to supply the winding devices 11 with feed bobbins 15, 16.

The traverse beam 8 serves as a travel rail for an automatic cheese changer 17.

Figure 1:
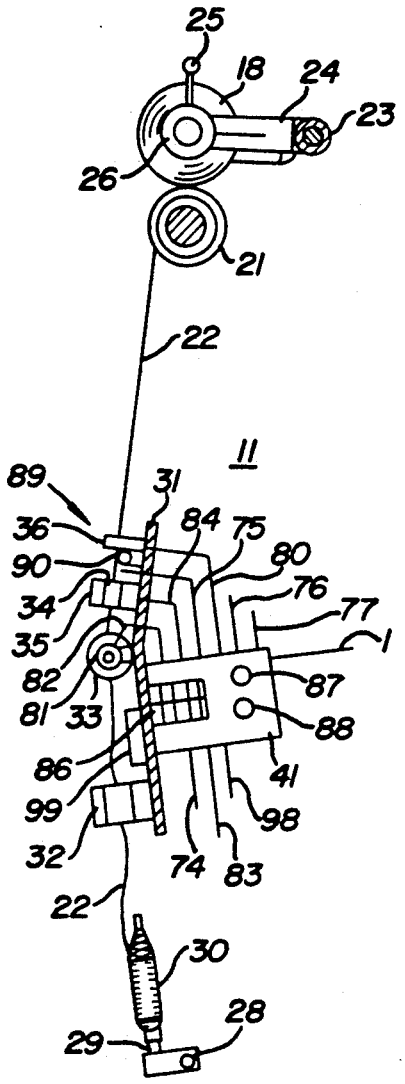
FIG. 1 is a diagrammatic side-elevational view of a winding station in an automatic winder, taken along the line I-I of FIG. 2, in the direction of the arrows.

The automatic winder 6 in this case serves as a machine that produces cross-wound bobbins or cheeses 18, as seen in FIGS. 1 and 2. The parts forming the individual winding device 11 of FIGS. 1 and 2 are as follows:

A machine housing 19 includes controllable drive device 20 for driving a cross-winding device 21 for yarn or thread 22 running up onto the cheese 18. In this exemplary embodiment, the cross-winding device 21 takes the form of a reversing thread roller, which simultaneously drives the cheese 18 by friction.

The machine housing 19 also carries a holder 23 for a creel 24 which is pivotably supported on the holder 23. A tube 27 of the cheese 18 is rotatably fastened into the pivotable creel 24 by means of a conventional clamping device 26 actuatable by a handle 25.

The machine housing 19 also has a holder 28 with a mandrel for holding a feed bobbin 30, which in this case is intended to be a spinning cop.

The machine housing 19 is also connected to a wall 31, which supports a yarn balloon breaker 32, a controllable yarn tensioner 33, a yarn cleaner 35 equipped with a yarn travel sensor 34, and a yarn guide device 36. The apex of a traversing triangle 37 defined by the yarn 22 as it travels up to line A and traverses back again, is located in the yarn guide device 36. FIG. 3 diagrammatically shows that the machine 6 producing the cheeses 18 has a monitoring information control system (MIC system) 38. An MIC system of this kind is already being used to operate automatic cheese winders. The MIC system permanently monitors each winding station in accordance with defined criteria.

Figure 4:
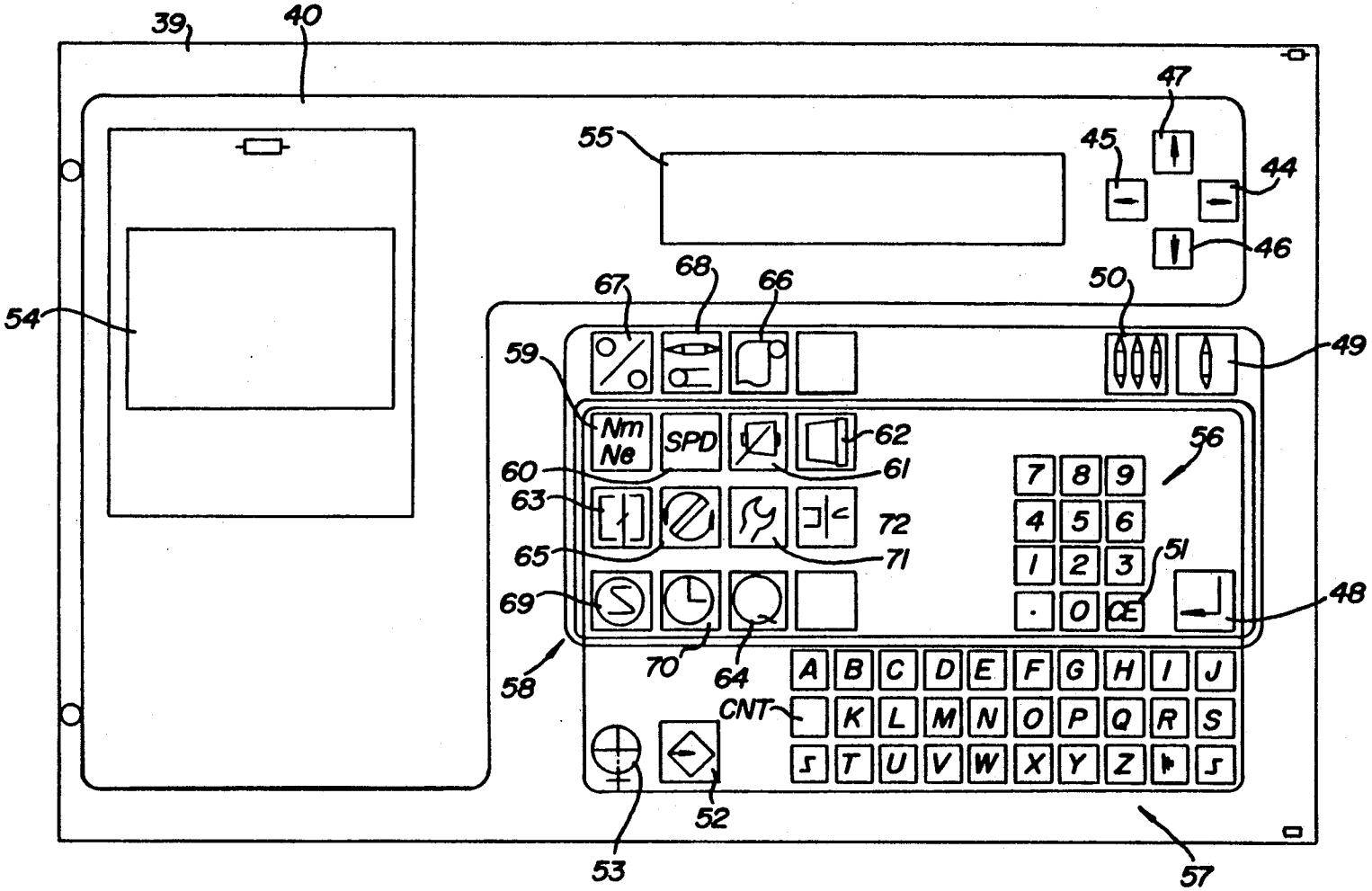
FIG. 4 is a front-elevational view of a central processing unit computer of the MIC system.

The symbolically illustrated MIC system 38 in FIG. 3 includes a central processing unit 39 with a front panel 40 shown in FIG. 4.

Data lines are provided for operative connections 1–5, among others, between the central processing unit 39 and winding station computers 41 of the various winding devices 11, the mobile cheese changer 17, a remaining yarn collecting station 42, the supply device 14, and a control device 43 for the yarn cleaner 35 of the various winding devices 11.

The front panel 40 includes, among others, control keys that enable dialing a working block to be explained below, scrolling within a working block, selecting individual functions, dialing a winding station group, dialing a winding device, and inputting and safeguarding data.

For instance, a switch from the basic display to the table of contents is made with a RIGHT control key 44. A switch is made, for instance, from a working block to the table of contents with a LEFT control key 45. The meaning of the working blocks will be explained below.

Scrolling downward can be performed within a working block or within a table of contents with a DOWNWARD control key 46. Scrolling upward can be performed within one working block or within the table of contents with an UPWARD control key 47. A switchover to the basic display is made with a RETURN control key 48 once an entry is completed. Data pertaining to an individual winding device are called up, or entries are made, with a WINDING STATION control key 49. Sampling pertaining to an individual winding station group, such as the section or winding station group I, are made possible, or entries are made, with a WINDING STATION GROUP control key 50. A CE control key 51 serves to cancel an entry made by mistake. Data input is initiated and completed with an ENTER control key 52. A control key 53 can only be actuated by a key (of the kind used for locks or the like). This serves the purpose of data protection. No one but the owner of a key that fits can undo the data protection and enable data input.

The front panel 40 also includes a printer 54, a display area 55 for a 20-place alphanumeric display, a numeric keypad 56, a keyboard 57 with letter keys, and a key area 58 with symbol keys, which will be described in further detail below in conjunction with the explanation of the working blocks.

Keys that belong to a working block A (batch parameters) are a key 59 for setting yarn fineness and yarn count, a key 60 for setting the winding speed, a key 61 for setting the set-point length of the yarn, a key 62 for setting the set-point diameter of the cheese, and a key 63 for setting the preparation of the yarn ends for splicing.

A key in a block B (quality specification) is a key 64, with which the number of allowable cleaner circuits, or yarn flaws to be corrected, can be preselected. The key 64 generally serves to specify tolerances in a winding operation.

A key 65 with which a new batch is started belongs to a working block C (batch control).

A key 66 with which an intermediate log can be called up for each winding station group belongs to a working block D (printer functions).

A symbol key 67 for calling up the machine efficiency and a key 68 for calling up the number of cops processed at a given time, belong to a working block E (production data).

A key 69 for loading the basic setting and a key 70 for setting the time of day, belong to a working block F (machine parameters).

A key 71 for a test mode and a key 72 for starting a winding device after an unprogrammed blockage of the yarn cutter, belong to working block G (service).

As is shown in FIGS. 1 and 2, each winding device 11 has sensors monitoring the yarn winding production process, which are connected to the winding station computer 41 and therefore are connected through the data lines or operative connections 1 to the central processing unit 39 of the MIC system 38.

The following sensors are provided:

A feed bobbin sensor 73 is connected to the bobbin station computer 41 through a line 74, the yarn travel sensor 34 is connected to the bobbin station computer 41 through a line 75, a drum rpm sensor 78 is connected to the bobbin station computer 41 through a line 76, and a bobbin diameter sensor 79 is connected to the bobbin station computer 4I through a line 77. Sensors which are integrated into the yarn guide device 36 are also connected to the bobbin winding station computer 41 through a line 80. Alternatively, the bobbin diameter can be derived from the bobbin rpm, so that the sensor 79 may alternatively be an rpm sensor.

The following manipulators are likewise connected to the winding station computer 41:

A brake force adjuster 81 is connected to the winding station computer 41 through a line 82, and the drive device 20 of the winding drum 20 is connected to the bobbin station computer 41 through a line 83. The yarn cleaner 35 is also connected to the winding station computer 41 through a line 84 and is thus detected by the MIC system.

According to FIG. 3, the MIC system 38 also includes an electronic memory 85 for the actual data occurring during production, and naturally also contains configurations for data processing in accordance with programs as well as non-illustrated configurations for issuing control commands and signals.

Through the use of the sensors connected to the MIC system 38, any change in production and the current yarn length of the various cheeses can be detected continuously and processed into control signals, report signals and logs in the MIC system 38 itself.

For instance, the yarn length running up onto the cheese 18 is detected by having the drum rpm sensor 78 count the drum rotations. Upon each drum rotation, a certain yarn length is wound onto the cheese 18. The yarn travel sensor 34 outputs a yarn travel signal over the line 75. If the yarn travel signal is suddenly absent, then as a rule the feed bobbin 30 has run out, or a yarn break has occurred. The yarn length counter integrated into the MIC system 38 stops, and it does not start counting again until the yarn travel sensor 34 again reports yarn travel.

The feed bobbin sensor 73 also monitors production in the sense that it can control either the brake force adjuster 81 or the drive device 20, or both simultaneously, with the aid of the MIC system, for instance in accordance with the remaining winding size on the feed bobbin.

The bobbin station computer 41 has a keyboard 86 as seen in FIG. 1. Set-point values or correction values pertaining to the winding device 11 can also be individually input on the keyboard 86, in a manner similar to that for the keyboards of the central processing unit 39. The winding station computer 41 is also capable of issuing report signals pertaining to production or malfunctions thereof, through visual alarms or displays 87, 88.

A cross-winding monitoring system which is designated as a whole by reference numeral 89 in FIGS. 1 and 2, is present at the winding device 11. The system 89 has measuring instruments which are connected to the MIC system 38 through the winding station computer 41, for continuously monitoring the traversing amplitude (FIG. 2) and/or the traversing frequency of the yarn 22 running from the yarn guide device 36 through the cross-winding device 21 onto the cheese 18, and for generating signals proportional to the traversing amplitude and/or traversing frequency.

The MIC system 38 is provided for linking these cross-winding signals with the aid of a logic element of the type that is present in every computer, in such a manner that conclusions as to various selectable characteristics of the ongoing winding process can be obtained from the resultant linkage. Suitable switching or shut-off, control and information events can optionally be tripped at the same time, as a reaction to these conclusions.

Figure 5:
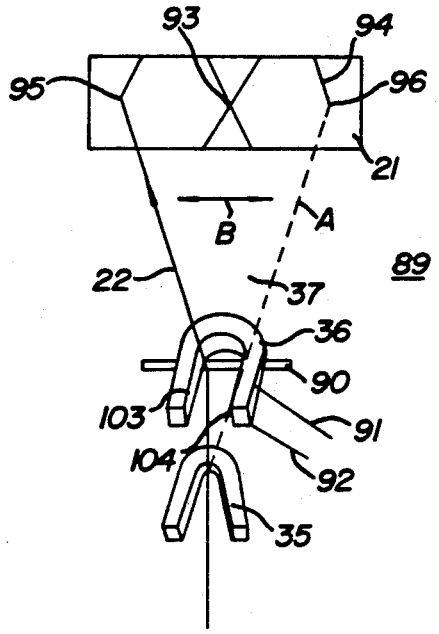
FIGS. 5–8 are perspective and elevational views of crosswinding monitoring systems.

FIG. 5 diagrammatically illustrates an exemplary embodiment of the cross-winding monitoring system 89. Above a guide element 35' disposed at the outlet end of the yarn cleaner 35 shown in FIGS. 1 and 2, the yarn 22 travels through a yarn guide bar 90, which can alternatively be replaced by an edge of the housing or the like, and then through the yarn guide device 36, which is constructed as a U-shaped triboelectric element. The triboelectric element 36 has two electrical connections 91 and 92, which are combined to make the line 80 seen in FIG. 1.

At full traversing amplitude B, the traveling yarn 22 alternatively rubs the left and right arm of the triboelectric element 36, so that in the present embodiment of the crosswinding device 21 having four intersections 93 of a reversing thread groove 94 (two intersections being located on the back of the drum, where they cannot be seen in the drawing), one cross-winding signal is sent to the winding station computer 41 per rotation of the winding drum or cross-winding device 21. The MIC system 38 is connected in such a way that it recognizes this as a normal drum function and normal yarn feeding.

Misfeeds of the yarn 22 can occur if the yarn changes direction at one of the intersections 93. For instance, if it changes direction at the intersection 93 that is visible in FIG. 5, then it can only reach one arm of the triboelectric element 36, but not one arm and then the other in alternation. The MIC system recognizes this yarn misfeed immediately. If it occurs relatively often, then depending on the misfeed tolerances set at the keyboard 86, winding operation is either continued and a quality reduction signal is issued, or the winding device 11 is stopped and a signal is issued that indicates inadequate bobbin quality.

Misfeeds could also occur in which the traveling yarn 22 does not even reach reversing points 95 and 96 at all but instead always changes its direction at the intersections located at the back of the reversing thread or winding groove 94, which are not visible in FIG. 5. In that case, the traversing triangle would only have the traversing amplitude C of FIG. 2. The width of the opening of the triboelectric element 36 is adjusted in such a way that the traveling yarn 22 then no longer comes into contact with the triboelectric element 36. The cross-winding signals remain absent, and this is immediately recognized as a serious yarn misfeed and is provisionally interpreted as a drum malfunction. This kind of traversing behavior of the yarn 22 leads to an immediate stoppage of the winding device 11 and to the issuance of a malfunction signal, which appears not only at the winding station computer 41 but also in the display field or area 55 of the central processing unit 39, and which upon callup is also printed in a log by the printer 54. Drum laps or bobbin laps of damaging size cannot even begin to occur in this case. The length of yarn that has run up without traversing can be eliminated by winding it in reverse and removing it by suction. The MIC system can add up the number of aspiration events, and if a given summation value is attained, premature emptying of the remaining yarn collecting station 42 can be brought about through the control line 3.

With the aforementioned interpretations of the cross-winding signal, it is understood that the yarn travel sensor 34 emits a yarn travel signal to the winding station computer 41, and that the bobbin diameter sensor 79 ascertains the increase in diameter of the cheese 18 that corresponds to the winding speed measured by the drum rpm sensor 78.

If only yarn misfeeds still occur, then either a so-called bobbin lap or a so-called drum lap will be produced relatively quickly. In a bobbin lap, the yarn runs only over a limited region of the bobbin, and this is detected by the bobbin diameter sensor 79 in the form of a rapid increase in bobbin diameter. The MIC system shuts off the winding device 11 in accordance with the tolerances set at the keyboard 86, and issues a corresponding malfunction signal.

If the yarn is running during an abnormal cross-winding signal, and the diameter of the cheese 18 is not increasing, this is interpreted by the MIC system as a drum lap, in which a bead of yarn forms on the winding drum 21. The consequence is immediate shutoff of the winding device 11 and the issuance of a malfunction signal.

However, the cross-winding signals also serve to provide continuous monitoring of the cheese 18 for so-called ribbon breaking, in other words, diamond-shaped or net-like patterns applied in profiled form onto the surface of the cheese 18 because of unfavorably located yarn intersections. Unless such ribbon windings are avoided, malfunctions will later occur when the yarn is drawn off the cheese from above, because of increases in yarn tension and winding falloffs. It is self-evident that bobbins wound in this way can only be poorly or unevenly dyed.

The MIC system is an aid to timely recognition of the tendency to form such ribbon windings, so that provisions for preventing ribbon winding can be made in good time.

The ribbon breaking state is interpreted as good if the traversing frequency does not agree with the bobbin rpm. The bobbin rpm is monitored by a bobbin rpm sensor 97, which is connected by a line 98 to the winding station computer 41, as seen in FIGS. 1 and 2. However, the ribbon breaking state is interpreted as good only if the traversing frequency is not an even multiple of the bobbin rpm. In contrast, the ribbon breaking state is interpreted as in need of improvement if the bobbin rpm approaches a multiple of the traversing frequency. In that case, the MIC system calls for countermeasures that, for instance, are in the form of switching the drive unit 20 on and off periodically until the threatened diameter range has been exceeded and ribbon breaking is no longer necessary for some time.

As mentioned above, in the illustrated exemplary embodiment, the yarn tensioner 33 is provided with the brake force adjuster 81. This is a small control motor that can vary the initial spring tension of the yarn tensioner 33. The MIC system 38 is connected in such a way that it interprets the function of the yarn tensioner 33 as satisfactory if the ratio between the traversing frequency and the bobbin rpm is decreasing steadily, but very slowly, in accordance with the growth of the bobbin as it is wound. If there are fluctuations in the ratio, the MIC system interprets the function of the yarn tensioner 33 as unsatisfactory. If the fluctuations exceed the tolerance limits set at the keyboard 86, then the winding device 11 can be stopped and a malfunction signal issued. If nothing but deviations from the expected ratio occur, countermeasures can be taken that are in the form of adjusting the break force adjuster 81.

The cross-winding devices or winding drums 21 are interchangeable. For instance, the cross-winding device shown can be replaced with another, that has a different diameter and a different number of intersections of the reversing thread groove.

The MIC system is connected and programmed in such a way that it can ascertain and display the type of cross-winding device. The MIC system also monitors whether or not all of the winding devices are equipped with cross-winding devices of the same type. The MIC system ascertains the type of cross-winding device from the ratio between the traversing frequency and the drum rpm or the rpm of the bobbin tube 27 at the beginning of winding.

The MIC system can also judge the quality of the cheese 18 in accordance with various criteria and display it, for instance in the display field 55. These criteria are, for instance, the number and duration of misfeeds; the number of drum laps and bobbin laps to be eliminated; the ribbon breaking state during bobbin travel; the yarn tensioner function or yarn tension variation during bobbin travel; the number, severity and duration of drum malfunctions; the number of yarn breaks to be eliminated; the number of yarn piecing events, or the number of times an automatic splicer 99 symbolically shown in FIGS. 1 and 2 has been used; and the number of uses of the supply device 14 for supplying the applicable winding device with feed bobbins. The splicer 99 is also connected to the winding station computer 41, and the basic settings of all of the splicers are entered centrally with the aid of the aforementioned control device 43, for instance by controlling the central supply of compressed air to the splicers.

For instance, from all of these criteria, the MIC system can add up evaluation points in accordance with a point evaluation table and store them in memory for each individual cheese, so that the cheeses then are provided with appropriate labels indicating their quality.

The MIC system 38 also monitors the current yarn length of each cheese 18. As already mentioned, this is done by counting the rotations of the drum 21 while the yarn 22 is simultaneously traveling. A yarn length can be preselected at the keyboard 86 of each winding station, or at the keyboard 56 of the central processing unit 39, upon the attainment of which the MIC system stops the applicable winding device.

The MIC system is configured for dialog operation with the machine 6 to be monitored and with the machine operator. In order to facilitate this dialog mode, a plurality of group memories are available in the MIC system 38. In the present exemplary embodiment, group memories 101 and 102 are provided and shown in FIG. 3 for the sections or winding station groups I and II. They are used by the central processing unit 39 for taking over basic setting values, for picking up production parameters, and for storing the actual data occurring during production for the associated winding station groups I, II.

If the cross-winding monitoring unit 89 is constructed in accordance with FIG. 5, the triboelectric element 36 is used as the sensor disposed next to the traversing triangle 37. Due to its U shape, the triboelectric element 36 forms end stops 103, 104 for the traveling, traversing yarn 22, and upon contact with the yarn 22 it issues a signal or pulse. In the MIC system 38, the pulse is recognized as a crosswinding pulse only if a yarn travel signal has been issued by the yarn travel sensor 34 at the same time. If not, the winding device is stopped and a malfunction signal is issued.

Figure 6:
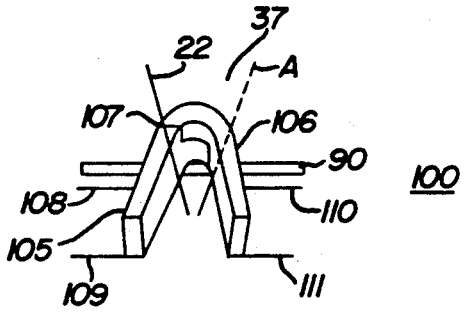

A cross-winding monitoring system or unit loop of FIG. 6 differs from the cross-winding monitoring system 89 of FIG. 5 in the following aspects:

A sensor 105, 106 is disposed at each respective side of the traversing triangle 37. The two sensors 105, 106 are interlocked in such a way that an insulating parting line 107 is formed at an interlocking location. Each sensor 105, 106 has two electrical leads 108, 109 and 110, 111, respectively. The parting line 107 permits an opening of the yarn guide formed by the electrodes 105, 106 to vary in extent. If both sensors 105, 106 are intended to have a common electrode lead, then the parting line 107 can be used for this purpose, but in that case it need not be provided as an insulating location.

Figure 7:
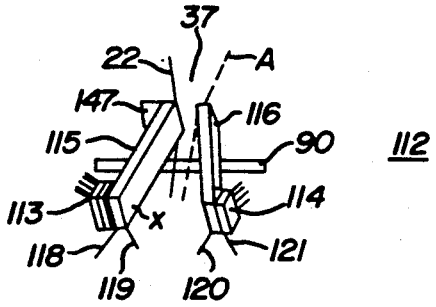

The structure of a cross-winding monitoring system or unit 112 of FIG. 7 differs from the structure of the cross-winding monitoring system 89 of FIG. 5 with regard to the following features:

In this case, two sensors 113 and 114 are disposed at the traversing triangle 37. The sensors are constructed as piezoelectric elements which respond to pressure. The pressure is transferred by the traversing yarn 22 to the sensors 113, 114 in the following manner:

Each sensor 113, 114 is provided with a bar 115, 116. The two bars 115, 116 define the lower end of the traversing triangle 37. The bars 115, 116 are stressed for flexion by the force of the traversing yarn. Alternatively, the bars may be constructed as flexion bars, and their flexion can be detected by strain gauges. It would be suitable to position a strain gauge at a point X on the bar 115. An exaggeratedly large elastic flexion of the bar 115 has been shown by a broken flexing line 117. The forces of flexion are perceptible at the sensors 113, 114 in the form of pressure changes, which generate alternating electric voltages. The electrical signals pass to the winding station computer 41 through respective electric line leads 118, 119 or 120, 121. In the MIC system 38 or in the winding station computer, they are recognized as cross-winding signals, as long as a yarn travel signal is simultaneously being furnished by the yarn travel sensor 34.

Alternatively, the sensors 113, 114 may be provided as sensors that respond to flexion or elongation.

Figure 8:
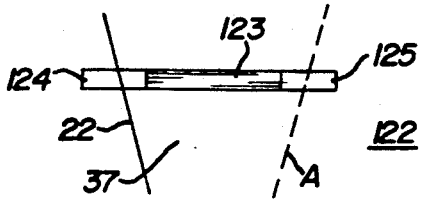

A cross-winding monitoring system or unit 122 of FIG. 8 differs from those described above with respect to the following features:

The system 122 has a yarn sensor 123 disposed next to the traversing triangle 37, which is contacted by the yarn 22 during the cross-winding process, but at the end of its traversing motion the yarn 22 moves past the sensor 123, so that the yarn signal ceases until the return of the yarn 22. The sensor 123 is provided as a triboelectric element, which changes into two metal tubes or conductive electrodes 124, 125 at the left and right, forming a smooth, bar-like sliding surface for the traversing yarn 22. The metal tubes 124, 125 serve as electrode leads for the yarn sensor 123.

The MIC system utilizes either the yarn signal of the sensor 123, which appears at the rhythm of the traversing frequency, or alternatively utilizes the interruption signals of the yarn signal as a measure for the traversing frequency and/or for the adequate level of the traversing amplitude.

For instance, the traversing amplitude is too small if the yarn signal is no longer at all rhythmic, or clocked. Cross-winding malfunctions are present if the traversing frequency suddenly becomes less. Very generally, the sensors in the exemplary embodiments may have strain gauges, elongator strips, triboelectric elements, piezoelectric elements, Hall elements and/or semiconductor modules.

I claim:

1. Method for monitoring the yarn winding production process of bobbin winders of a machine producing cross-wound bobbins or cheeses, which comprises monitoring at least one of the traversing amplitude and traversing frequency of a yarn running from a stationary yarn guide device through a cross-winding device onto a cheese with a cross-winding monitoring system emitting signals proportional to at least one of the traversing amplitude and traversing frequency;

supplying the signals to a control and information system of the machine specifying set-point values determining a winding operation; monitoring adherence to the set-point values with sensors connected to the control and information system, influencing at least one of drive devices and yarn guide devices and tripping information and reporting and switching events pertaining to the winding operation with the control and information system in the event of deviations from the set-point value for assuring the winding operation; and linking the signals proportional to at least one of the traversing amplitude and traversing frequency with at least one of the set-point values and signals and information characterizing the winding operation in the control and information system with a logic element, for drawing conclusions from the result of the linkage as to a plurality of selectable characteristics of the winding process from the group consisting of misfeeds, drum laps, bobbin laps, ribbon winding state, yarn tensioner function, yarn tension change, drum malfunction, cheese grading, type of cross-winding system and quality of the cheese.

2. Method according to claim 1, which comprises carrying out the step of influencing at least one of the drive devices and the yarn guide devices with the control and information system in an open or closed-loop manner.

3. Method according to claim 1, which comprises obtaining the signals and information characterizing the winding operation with sensors monitoring winding operation.

4. Method according to claim 1, which comprises simultaneously tripping the switching, control and information events as a reaction to the conclusions.

5. Method according to claim 1, which comprises calling up, displaying and logging the conclusions at any time.

6. Method according to claim 1, which comprises calling up the conclusions at any time.

7. Method according to claim 1, which comprises displaying the conclusions at any time.

8. Method according to claim 1, which comprises logging the conclusions at any time.

9. Apparatus for monitoring the yarn winding production process of winding devices of a machine producing cross-wound bobbins or cheeses having a yarn guide device and a traversing device, comprising an MIC (monitoring information control) system on the machine for permanently monitoring each winding device of the machine in accordance with definable and adjustable criteria, said MIC system including winding station computers for the winding devices, a central processing unit, set-point value transducers for production parameters and basic setting values, at least one memory for actual data occurring during production, devices for processing data according to programs, and a device for issuing control commands and signals;

means connected to said MIC system for controlling cheese production;

sensors connected to said MIC system for monitoring a yarn winding production process and for detecting each production change as well as the current yarn length of an individual cheese;

said MIC system having means for processing each production change and the current yarn length of the individual cheese into control signals;

a cross-winding monitoring system including measuring instruments on the winding devices being connected to said MIC system, said cross-winding monitoring system continuously monitoring at least one of the traversing amplitude and traversing frequency of yarn running from the yarn guide device through the traversing device onto a cheese and generating cross-winding signals proportional to at least one of the traversing amplitude and traversing frequency; and said MIC system having a logic element for linking the cross-winding signals and drawing conclusions from a linkage result as to a plurality of selectable characteristics of the winding process from the group consisting of misfeeds, drum laps, bobbin laps, ribbon winding state, yarn tensioner function, yarn tension change, drum malfunction, cheese grading, type of cross-winding system, quality of the cheese and current yarn length.

10. Apparatus according to claim 9, wherein said means for controlling cheese production are manipulators.

11. Apparatus according to claim 9, wherein said sensors detect each production change and the current yarn length of the individual cheese continuously.

12. Apparatus according to claim 9, wherein said sensors detect each production change and the current yarn length of the individual cheese at predeterminably short time intervals.

13. Apparatus according to claim 9, wherein each production change and the current yarn length of the individual cheese are also processed into report signals and logs in said MIC system.

14. Apparatus according to claim 9, wherein said logic element simultaneously trips switching, control and information events as a reaction to the conclusions.

15. Apparatus according to claim 9, including means for at least one of calling up, displaying and logging said conclusions at any time.

16. Apparatus according to claim 9, wherein the winding stations are divided into winding station group, said MIC system includes means for performing dialog operation with the machine to be monitored and with a machine operator, and said MIC system includes a plurality of group memories each being assignable to at least one winding device for adopting basic setting values, for receiving the production parameters, and for storing the actual data occurring during production of an assigned winding station group.

17. Apparatus according to claim 9, wherein the traveling traversing yarn defines a traversing triangle, and said cross-winding monitoring system includes a sensor disposed next to the traversing triangle forming an end stop for the traveling traversing yarn emitting a signal or pulse upon contact with the yarn.

18. Apparatus according to claim 17, wherein said sensor disposed next to the traversing triangle emits a yarn travel signal, and said MIC system includes means for recognizing the pulse as a cross-winding pulse only if the yarn travel signal is simultaneously emitted.

19. Apparatus according to claim 17, including a sensor separate from said sensor disposed next to the traversing triangle for emitting a yarn travel signal, said MIC system including means for recognizing the pulse as a cross-winding pulse only if the yarn travel signal is simultaneously emitted.

20. Apparatus according to claim 17, including another sensor disposed next to the traversing triangle, each of said sensors disposed next to the traversing triangle being disposed at a respective side of the traversing triangle.

21. Apparatus according to claim 17, including two end stops for the yarn each being disposed at a respective side of the traversing triangle and being connected to said sensor.

22. Apparatus according to claim 9, wherein the traveling traversing yarn defines a traversing triangle during a traversing motion, and said cross-winding monitoring system has a yarn sensor disposed next to the traversing triangle, the yarn touching said yarn sensor during the traversing motion for issuing a yarn signal and the yarn moving past said yarn sensor at the end of the traversing motion for issuing yarn interrupting signals until the return of the yarn, at least one of the yarn signal occurring at the rhythm of a traversing frequency and the interruption yarn signals representing a measure of at least one of the traversing frequency and an adequate height of a cross-winding amplitude.

23. Apparatus according to claim 17, wherein said sensors disposed next to the traversing triangle respond to at least one of flexion, pressure, friction, torsion and elongation.

24. Apparatus according to claim 17, including bars connected to said sensors disposed next to the traversing triangle.

25. Apparatus according to claim 17, including bending bars connected to said sensors disposed next to the traversing triangle.

26. Apparatus according to claim 17, wherein said sensors disposed next to the traversing triangle have at least one of strain gauges, elongator strips, triboelectric elements, piezoelectric elements, Hall elements and semiconductor modules disposed thereon.

27. Apparatus for monitoring the yarn winding production process of winding devices of a machine producing cross-wound bobbins or cheeses, comprising an MIC (monitoring information control) system for monitoring each winding device including winding station computers, a central processing unit, setpoint value transducers, and at least one memory;

means connected to said MIC system for controlling cheese production;

sensors connected to said MIC system for monitoring a yarn winding production process and for detecting each production change as well as the current yarn length of an individual cheese;

said MIC system having means for processing each production change and the current yarn length of the individual cheese into control signals;

a cross-winding monitoring system including measuring instruments on the winding devices being connected to said MIC system, said cross-winding monitoring system continuously monitoring at least one of the traversing amplitude and traversing frequency of yarn running onto a cheese and generating cross-winding signals proportional to at least one of the traversing amplitude and traversing frequency; and said MIC system having means for linking the cross-winding signals and drawing conclusions from a linkage result as to a plurality of selectable characteristics of the winding process.

* * * * *